US012151284B2

(12) United States Patent
Nobile et al.

(10) Patent No.: US 12,151,284 B2
(45) Date of Patent: Nov. 26, 2024

(54) METAL MATERIAL CONTAINMENT SYSTEM IN METAL PRODUCT CASTING

(71) Applicant: Danieli & C. Officine Meccaniche S.p.A., Buttrio (IT)

(72) Inventors: Matteo Nobile, Cervignano del Friuli (IT); Marco Ansoldi, Udine (IT); Nikolas Salvador, Sarmede (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 0 days.

(21) Appl. No.: 18/264,381

(22) PCT Filed: Feb. 10, 2022

(86) PCT No.: PCT/IB2022/051187
§ 371 (c)(1),
(2) Date: Aug. 4, 2023

(87) PCT Pub. No.: WO2022/172183
PCT Pub. Date: Aug. 18, 2022

(65) Prior Publication Data

US 2024/0033813 A1 Feb. 1, 2024

(30) Foreign Application Priority Data

Feb. 11, 2021 (IT) ..... 102021000003029

(51) Int. Cl.
*B22D 11/06* (2006.01)

(52) U.S. Cl.
CPC ..... *B22D 11/066* (2013.01); *B22D 11/0622* (2013.01); *B22D 11/064* (2013.01); *B22D 11/0682* (2013.01)

(58) Field of Classification Search
CPC ... B22D 11/06; B22D 11/0622; B22D 11/064; B22D 11/066; B22D 11/0682
USPC ..... 164/480, 428
See application file for complete search history.

(56) References Cited

U.S. PATENT DOCUMENTS 6,145,581 A * 11/2000 Takeuchi et al. .. B22D 11/0668 164/268

FOREIGN PATENT DOCUMENTS

| | | | |
|---|---|---|---|
| DE | 10055410 | A1 | 5/2002 |
| JP | S579566 | A | 1/1982 |
| JP | H04224050 | A | 8/1992 |

OTHER PUBLICATIONS

Patent Cooperation Treaty, International Search Report and Written Opinion for International Application No. PCT/IB2022/051187, Jun. 23, 2022, 13 pages.

* cited by examiner

*Primary Examiner* — Kevin P Kerns
(74) *Attorney, Agent, or Firm* — Stetina Brunda Garred & Brucker

(57) ABSTRACT

A containment system for laterally containing a liquid metal material or liquid metal alloy at an open side end of a passage defined between two casting members, the system including a pneumatic device ending with a hollow end element adapted to be arranged close to the open side end of the passage, wherein the hollow end element defines a chamber therein, wherein the pneumatic device is adapted to feed a compressed aeriform substance into the chamber, and wherein the hollow end element is provided with at least one blowing face for blowing the compressed aeriform substance from the chamber towards a side containment zone for the liquid metal.

20 Claims, 9 Drawing Sheets

METAL MATERIAL CONTAINMENT SYSTEM IN METAL PRODUCT CASTING

CROSS-REFERENCE TO RELATED APPLICATIONS

This application claims priority to PCT International Application No. PCT/IB2022/051187 filed on Feb. 10, 2022, which applications claims priority to Italian Patent Application No. 102021000003029 filed on Feb. 11, 2021, the entire disclosures of which are expressly incorporated herein by reference.

STATEMENT RE: FEDERALLY SPONSORED RESEARCH/DEVELOPMENT

Not Applicable

BACKGROUND

Field of the Invention

The present invention relates to a system for containing liquid or semiliquid metal material, for example aluminum, zinc, magnesium or any metal alloy, during an operation of casting, preferably flat, metal products, for example strips, according to the technology commonly known as Twin Roll Casting, or according to other alternative casting technologies using two casting members to define the flat metal product.

Background Art

The technology commonly known as Twin Roll Casting is a well-known technology, in use since the middle of the 20th century to manufacture solid metal semi-finished products starting from liquid material. This technology is used to mainly manufacture flat strips but can also be adapted to be used for long products such as billets, bars or the like, because it allows increased productivity for thin formats (thickness or diameter generally up to 10 mm) and because such shapes can be cast at a high speed with the Twin Roll Casting as compared to other casting technologies. Another advantage of Twin Roll Casting is that of allowing the size of thin and small formats of the semi-finished products to be similar to the shape of the final product, thus decreasing the shaping work (rolling, drawing) in the processes downstream and contributing to obtaining a final product which is cheap and manufactured in large quantities.

Various materials can be used for Twin Roll Casting, such as ferrous alloys and non-ferrous alloys, or pure metals.

In the conventional steel casting configuration, Twin Roll Casting is actuated by a two-high stand with cooled horizontal rolls arranged parallel and placed side-by-side, with the axes thereof lying on a common horizontal plane; whereas the two cooled horizontal rolls for casting aluminum, magnesium, zinc and/or the alloys thereof, are placed one above the other, for example with the axes thereof lying on a common vertical plane or on a common plane which is inclined with respect to the vertical. The space defined by the casting rolls is fed by means of a discharger which brings the liquid metal material in contact with the cooled rolls to start solidification. The discharger is assisted, in its operation of sending and containing the material, by side barriers or edge dams which prevent the lateral spreading of the liquid or semiliquid material prior to the complete solidification thereof and which can be part of the discharger itself or separate components. Generally, the discharger is fed by a system of channels and furnaces that are different according to the material to be cast and the features thereof. Generally, the liquid material is conveyed by gravity or by using pumping means, and the channels are to be made of a material which has both isolating properties—to prevent drops in temperature and undesired local solidification of the material—and an adequate mechanical resistance in order to ensure the structural integrity and chemical compatibility with the alloy in the liquid state.

One of the most critical problems in casting a metal strip is the lateral spreading of the liquid material, which is caused by the edge working conditions and by the solidification parameters.

Generally, with increased casting loads, flow conditions of the liquid and low casting speed can promote a privileged cooling in the edges of the strip so that the results are a partial lateral spreading of the strip, an improved dimensional control and decreased risk of leaks. However, this generates worse local quality of the strip and the need for the side part of the strip to be trimmed.

The working conditions can be changed in order to have more uniform casting conditions even on the sides, but this can result in the risk of increased side leaks of the liquid material, which sticks to the casting roll and damages the equipment, thus also inducing the process to stop. This could be avoided by improving—by means of mechanical barriers—the side containment of the strip prior to solidification, but there are certain limitations from a technical viewpoint to obtain these results.

Indeed, the mechanical side containment systems, or mechanical edge dams, are not to be made of materials capable of reacting with the liquid material coming out of the casting device and, if they are made of isolating materials, they are not capable of effectively containing the material. Moreover, such materials must not excessively resist the rolls to avoid sliding damage to the rolls due to accidental contact. Generally, in order to meet these requirements, such materials preferably are soft materials such as, for example, oxide refractory materials. Moreover, when the casting load decreases, there is a need to ensure an effective side containment also in points which are rather distant from the discharger outlet, in a position which is close to the outlet of the roll bite, i.e., the point of minimum distance between the casting rolls, and this requires using very long and very thin edge dams. The materials mentioned above do not allow achieving the required geometries of the edge dam or operating with the geometries required without incurring the yielding of the edge dam itself or damage to the surface of the casting roll. Instead, by using alternative materials such as steel or metals to construct the edge dams, a gluing effect of the liquid metal material, for example aluminum or alloys thereof, is obtained in addition to a quick wear caused by phenomena of chemical reactions, corrosion and/or abrasion, thus risking damaging the surface of the casting rolls.

Thus, the need is felt to provide a containment system capable of overcoming the stated drawbacks.

SUMMARY OF THE INVENTION

It is an object of the present invention to provide a system for laterally containing liquid metal material, in particular aluminum or magnesium or zinc or a metal alloy based on one of these metals, in a casting of, preferably flat, metal products, said system being capable of improving performance in terms of both containing the liquid metal material at any casting load and extending the side containment region, while simultaneously avoiding the direct contact of the side containment device with the liquid metal material.

The system of the invention can be applied to a casting carried out according to the technology commonly known as Twin Roll Casting, or according to alternative casting technologies which use two casting members to define the flat metal product.

It is another object of the present invention to provide a containment system which is flexible, thus allowing various widths of metal product to be cast without the need to replace the casting members.

The present invention achieves at least one of such objects, and other objects which will become apparent in light of the present description, by means of a containment system for laterally containing an at least partially liquid metal material at an open side end of a passage defined between two casting members, said system comprising a feeding device for feeding at least one compressed aeriform substance, wherein said feeding device is provided with a hollow end element adapted to be arranged close to said open side end of the passage, wherein said hollow end element defines at least one chamber therein, wherein said feeding device is adapted to feed the at least one compressed aeriform substance into said at least one chamber, wherein said hollow end element is provided with at least one blowing face for blowing said at least one compressed aeriform substance from said at least one chamber towards a side containment zone for said at least partially liquid metal material, wherein said at least one blowing face is provided with a plurality of through holes;

and wherein two or more non-coplanar blowing faces are provided for differently orienting the flow of said at least one aeriform substance, or wherein there is provided a single blowing face in which two or more groups of through holes are provided, each group being differently oriented from the other groups.

Another aspect of the invention relates to a casting machine for casting metal material products, comprising:

two casting members defining a passage having two open side ends, for solidifying the liquid metal material fed into a space between said casting members and forming a product;

a first containment system as mentioned above, arranged close to a first open side end of said passage;

preferably a second containment system as mentioned above, arranged close to a second open side end of said passage;

preferably wherein said two casting members are counter-rotating rolls or belts or tracks or a combination thereof.

A further aspect of the invention relates to a casting process for casting metal material products, carried out by the aforesaid casting machine, the process comprising the following stages:

feeding the liquid metal material into the space between the two casting members;

solidifying the metal material and forming a product in the passage between the two casting members;

wherein a side containment of the liquid metal material is provided at least at one of the two open side ends of the passage by means of a first containment system;

and wherein the side containment of the liquid metal material is obtained by feeding at least one compressed aeriform substance to the at least one chamber of said hollow end element which, by means of the at least one blowing face, blows said at least one compressed aeriform substance from the at least one chamber towards the side containment zone for said liquid metal material;

preferably wherein a first side containment of the liquid metal material is provided at a first open side end of the passage by means of said first containment system, and a second side containment of the liquid metal material is provided at a second open side end of said passage by means of a second containment system.

In this description, reference is made by way of example to Twin Roll Casting technology, which uses two counter-rotating rolls as casting members.

The solution of the invention consists in providing a barrier consisting of a compressed aeriform substance capable of containing the edge of the flat metal product, for example a strip, during the solidification process by applying a force on said edge so as to push the liquid metal material towards the middle of the strip and avoid side spreading or leaks of the molten material.

The principle of the invention is based on the use of a feeding device of at least one compressed aeriform substance, possibly partially shaped so as to be positioned very close to the casting machine rolls, on the side where the material enters into the rolls or on the side where the material exits from the rolls, or also on the side of the flanks of the rolls themselves. Such a feeding device is configured to blow the at least one compressed aeriform substance, for example air or inert gas, into the space between the rolls, from one side towards the middle. This compressed aeriform substance has the dual effect of cooling the liquid material on the edge of the strip, thus locally accelerating solidification, and of applying a mechanical containment action to prevent the liquid material from spreading.

There are many advantages to such a solution.

Firstly, the mechanical action is applied while avoiding contact between the liquid metal material and any other material, thus avoiding any chemical reaction, corrosion or wear.

More in detail, the solution of the invention does not provide any direct contact either between the hollow end element and any surface of the casting rolls, or between the hollow end element and the liquid metal material.

In particular, a distance other than zero is always provided between the hollow end element and any surface of the casting rolls both when the hollow end element is completely external to the casting rolls and when it is at least partially inserted between said casting rolls, for example with a wedge shape thereof.

The at least one blowing face of the hollow end element applies the containment action of the metal material exclusively by blowing the compressed aeriform substance, without providing any contact thereof with the material being solidified, in order to prevent the lateral escape of the material from the rolls.

Moreover, a further advantage is that the containment action can be applied to any point between the rolls which instead, in the prior art, cannot be achieved by any physical barrier due to the limited space. For example, the jets of air or inert gas can be oriented towards the middle of the roll bite, also for very low casting thicknesses. Indeed, in this case, a physical barrier cannot be interposed between the rolls very close to the roll bite due to the limited gap imposed by the final thickness of the cast product, for example a strip.

Finally, a considerable advantage of the blowing action is the possibility of sealing any gap between the rolls even if the roll position is changed, without any adjustment being required. For example, the solution of the invention continues to work in the case of software-controlled roll position and of an unexpected change in the load set due to casting conditions which could determine occasional roll movements.

The containment system of the invention can generate more concentrated or diffused jets according to the geometry thereof so as to distribute the containment action by adequately adjusting it to the operating conditions and minimizing the consumption of air or inert gas. Moreover, the pressure and mechanical thrust action of the insufflated gas can be regulated to compensate for the different metallostatic pressure of the molten material.

The pneumatic system or edge dam solution of the invention also allows meeting the following requirements:

- laterally containing the metal material subject to high pressure, for example up to 100-120 mm of liquid metal head;
- the side containment region involved can vary in length, for example from 45 to 70 mm (setback);
- the system is flexible and allows various strip widths to be cast without the need to replace the casting rolls with other rolls having different lengths.

Further features and advantages of the invention will become more apparent in light of the detailed description of exemplary but not exclusive embodiments.

The dependent claims describe particular embodiments of the invention.

BRIEF DESCRIPTION OF THE DRAWINGS

In the description of the invention reference is made to the accompanying drawings, which are provided by way of non-limiting example, in which.

The same elements or components are indicated by the same reference numerals in the drawings.

DESCRIPTION OF EXEMPLARY EMBODIMENTS OF THE INVENTION

The containment system of the invention can be applied to a casting carried out according to the technology commonly known as Twin Roll Casting, or according to alternative casting technologies which use two casting members to define the flat metal product.

For example, this alternative casting technology can be one of the following:

- Single Roll Casting, in which the flat metal product is solidified by contact with a single, water-cooled rotating roll, starting from the space delimited by said roll and by the nozzle of a discharger, for example a tundish; here, the two casting members are the single roll and said nozzle;
- Twin Belt Casting or twin track casting (also known as twin block casting), in which the flat metal product is solidified in the passage between two counter-rotating belts or tracks, respectively;
- combined roll-belt, roll-track or track-belt casting.

In this detailed description, reference is made by way of example to Twin Roll Casting technology, which uses two counter-rotating rolls as casting members.

Figure 1:
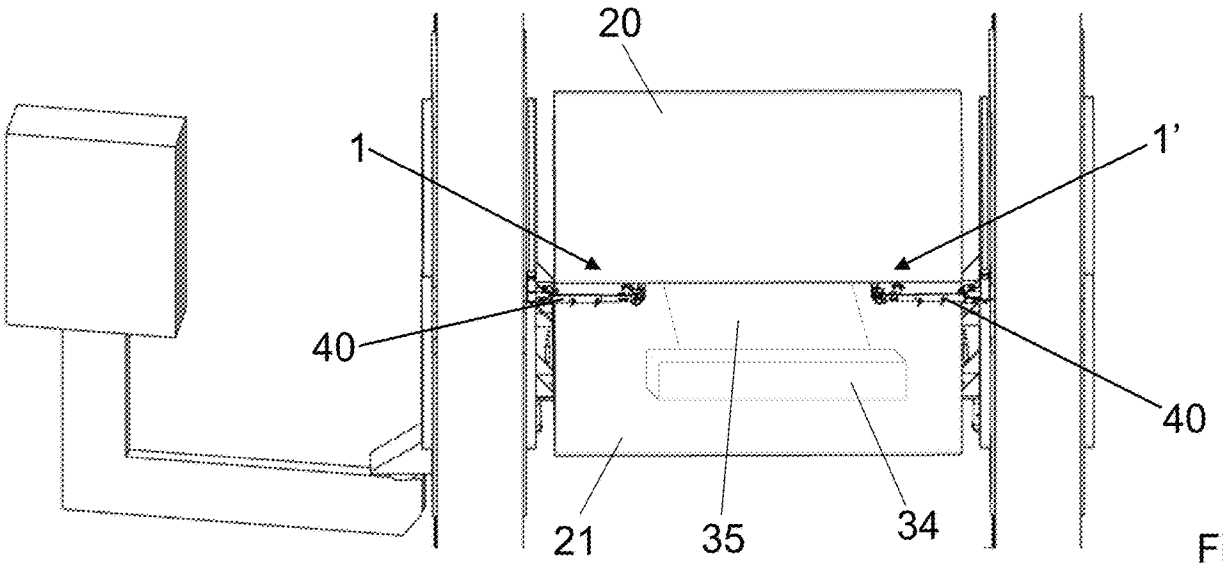
FIG. 1 shows a view of a horizontal casting machine with side containment systems according to the invention.

FIG. 1 shows an example of a horizontal casting machine with two horizontal casting rolls 20, 21 positioned one above the other, with the axes thereof lying on a common vertical plane, said machine comprising a pair of containment systems 1, 1' of the invention. However, the systems of the present invention can also be used in casting machines with the axes of the two rolls lying on a common plane which is inclined with respect to the vertical. In particular, a vertical casting machine with the two casting rolls arranged parallel and placed side-by-side and with the axes thereof lying on a common horizontal plane, can be used.

Figure 2:
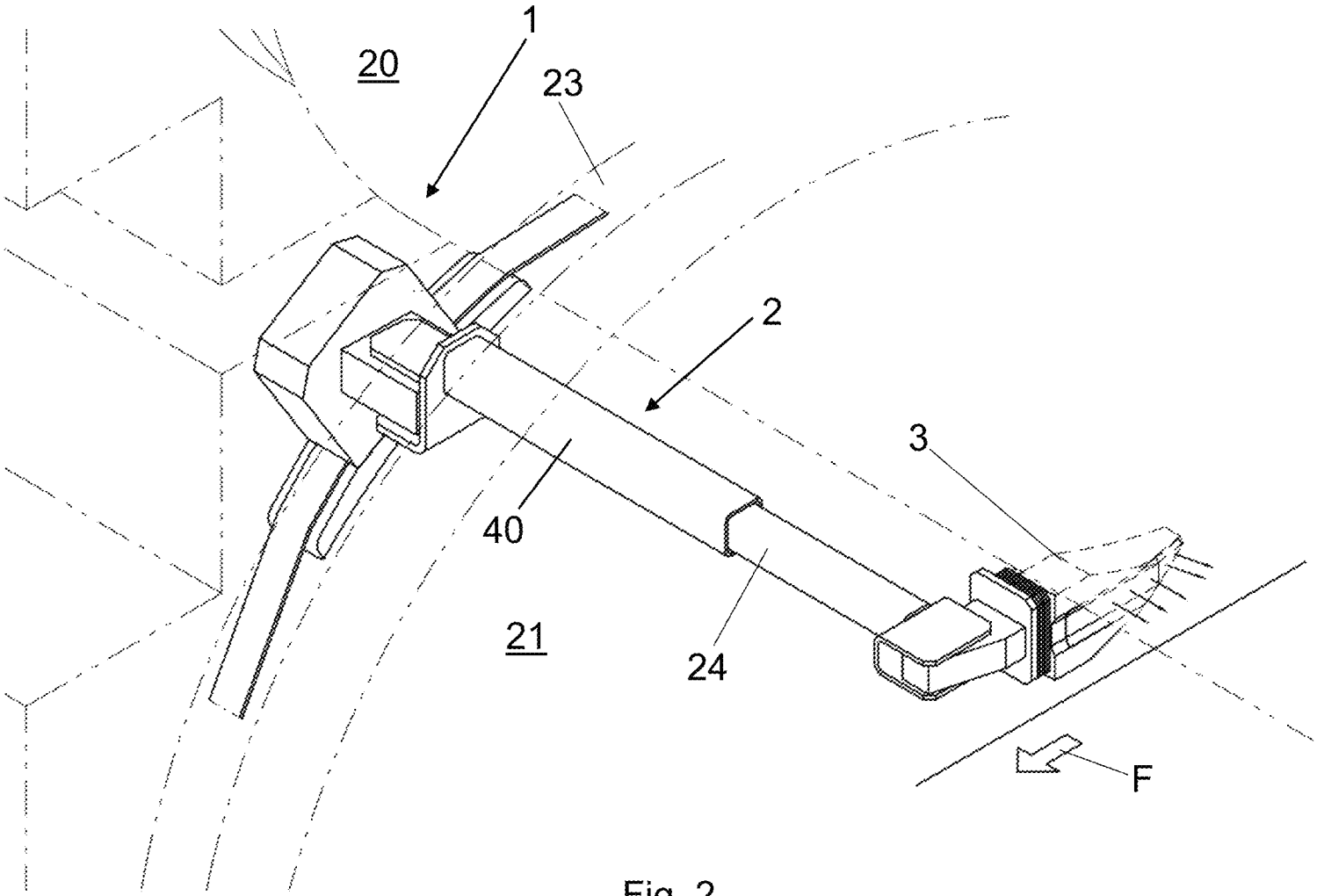
FIG. 2 shows a perspective view of a system of the invention.

In the version shown in FIGS. 1 to 2, the casting machine, in order to cast flat metal material products, for example strips, preferably made of aluminum, zinc, magnesium or alloys thereof, comprises:

- two counter-rotating and superimposed casting rolls 20, 21, defining an outlet passage for the metal material to be cast having the two open side ends, for solidifying the liquid metal material and forming a flat product;
- feeding means for feeding the liquid metal material into a space between the two casting rolls, towards the passage defined between the two casting rolls;
- a first containment system 1, arranged close to a first open side end of the passage;
- preferably a second containment system 1', arranged close to a second open side end of said passage.

It is sufficient to use a single containment system if it is necessary to laterally contain the liquid metal material only at one of the two side ends of said passage.

The feeding means, which are known per se, comprise:

- a tundish 34 for collecting the liquid metal material, for example coming from an inlet channel (not shown);
- a discharger 35, preferably made of ceramic material, for feeding the liquid metal material coming from the tundish 34 towards the passage delimited by the two casting rolls 20, 21.

Moving means (not shown) for moving the first containment system 1 and/or the second containment system 1' can be provided in order to adjust the distance from each other along a direction parallel to the plane containing the rotation axes of the two casting rolls 20, 21. Such moving means can, for example, be linear actuators, such as hydraulic, pneumatic, mechanical actuators, combinations thereof or the like.

This allows different widths of metal product to be cast, for example strips, without the need to replace the casting rolls. The passage from one size to the other of strip to be produced only requires laterally displacing at least one of the two side containment systems 1, 1' with respect to the casting rolls 20, 21 along said direction. This also applies in case of a single containment system.

Therefore, width—which is fixed—of the casting rolls being equal, the side containment system can be moved so as to define different widths of the strip to be cast, and therefore there is no need to have dedicated roll sets as in the prior art, in which the containment system cannot be laterally moved and therefore, the casting rolls need to be changed each time strips of different widths are cast.

The containment systems 1, 1' in FIG. 1 are arranged on the side where the metal material (liquid metal) enters into the space between the two casting rolls 20, 21; while FIG. 2 shows a single containment system 1, the latter being arranged on the side where the metal material (cast product) exits from the casting rolls 20, 21. The feeding direction of the metal material is indicated by arrow F in FIG. 2.

In another variant, one or two containment systems can be provided on both the metal material inlet side and the metal material outlet side.

In all the embodiments of the invention, each side containment system 1, 1' of the material being cast, at the respective open side end of the passage defined between the two casting rolls 20, 21, comprises (FIG. 2) a feeding device 2 for feeding at least one compressed aeriform substance, provided with a hollow end element 3 adapted to be arranged close to said open side end of the passage defined by the casting rolls 20, 21.

The hollow end element 3 can at least partially have a wedge shape so that it can be possibly inserted, at least partially, between the two casting rolls at an open side end of the passage.

As an alternative to the wedge shape, the hollow end element 3 can have the shape of a rectangular or pyramidal parallelepiped, or any other shape adapted to position said hollow element close to the passage defined between the two casting rolls, said hollow end element 3 being possibly at least partially inserted between the two casting rolls at an open side end of the passage.

In the example in the drawings, the hollow end element 3 is wedge-shaped.

Preferably, each feeding device 2, and therefore the respective hollow end element 3, is positioned laterally and in an outer position, for example an entirely outer position, with respect to the zone occupied by discharger 35.

Figure 6:
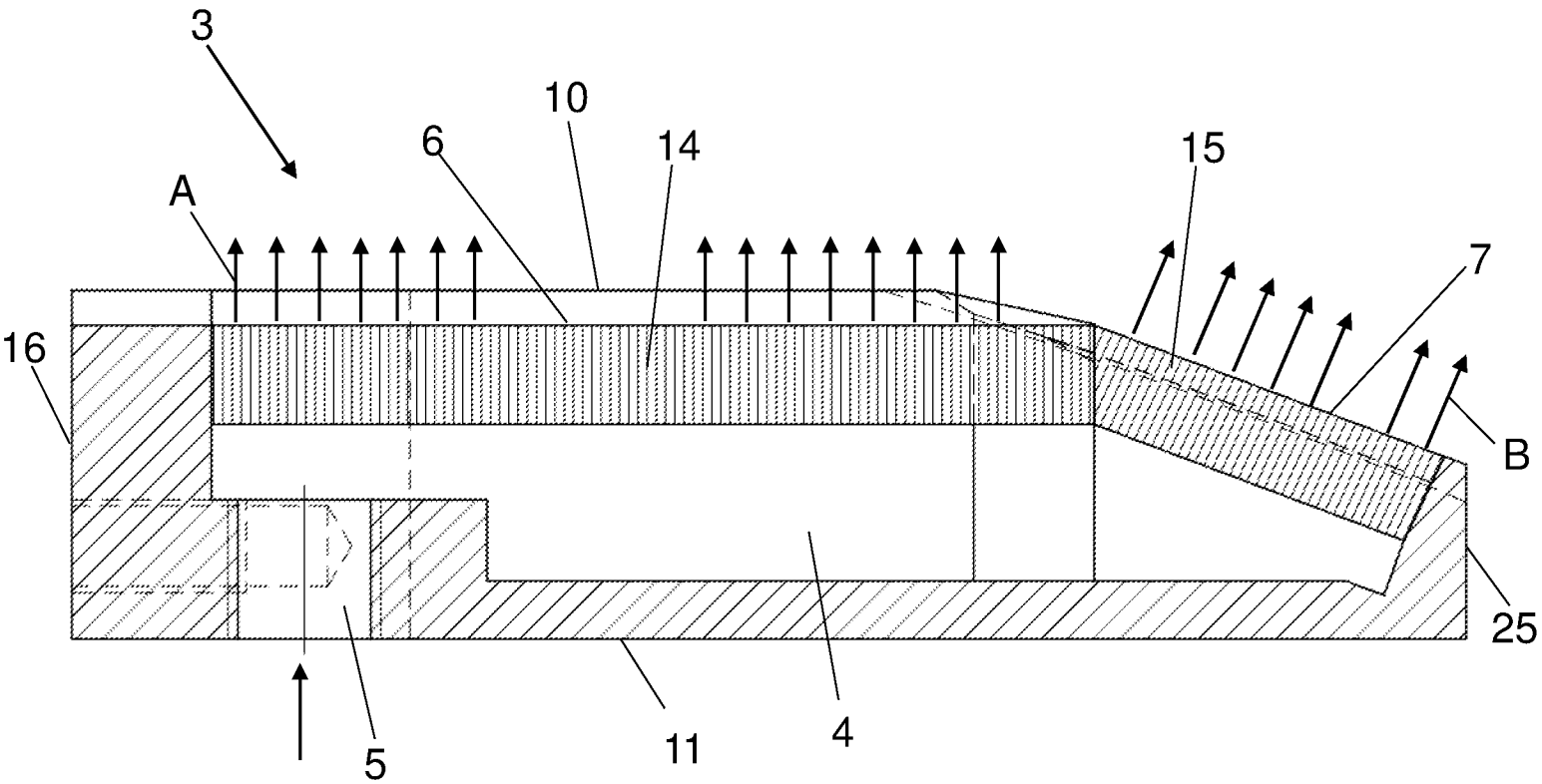
FIG. 6 shows a cross section view of the component in FIG. 5.

The hollow end element 3 defines therein at least one chamber 4, for example a single chamber, as shown in the non-limiting variant in FIG. 6. From two to six chambers can be provided in other variants. However, variants with a number of chambers greater than and even considerably greater than—six are not excluded, for example if the chambers correspond to porosities of the material with which the hollow element 3 is made.

The feeding device 2 is configured to feed at least one compressed aeriform substance, such as air or inert gas, inside the at least one chamber 4.

Advantageously, the hollow end element 3 is provided with at least one blowing face for blowing the compressed aeriform substance from said at least one chamber 4 towards a side containment zone for the metal material being cast between the casting rolls 20, 21.

As shown in the non-limiting example in FIG. 2, each containment system 1 can be installed at a first end thereof on the chock 23 of the lower casting roll 21 and is provided with a support arm 24 which supports the corresponding hollow end element 3 at a second end of the system, opposite to the first end.

Moving means 40 for moving the hollow end element 3 of one or both the containment systems 1, 1' can be provided in order to adjust the distance from each other along a direction parallel to the plane containing the rotation axes of the two casting rolls 20, 21.

For example, one moving means 40 is provided for each containment system 1, 1'.

In particular, the moving means 40 is configured to move the support arm 24 of the hollow end element 3 along a direction parallel to the plane containing the rotation axes of the two casting rolls 20, 21.

Such a moving means 40 can, for example be a linear actuator, such as a hydraulic, pneumatic or mechanical actuator. Preferably, the at least one blowing face is provided with a plurality of through holes communicating with the at least one chamber 4, or is made of a porous matrix material to ensure the release of jets of air or inert gas.

In all the embodiments of the invention, the hollow end element 3 comprises a first outer surface 10 adapted to face towards the side containment zone and comprising the at least one blowing face.

Preferably, the hollow end element 3 also comprises:

- a second outer surface 11, opposite to the first surface 10, preferably comprising at least one inlet hole 5 for the at least one compressed aeriform substance,
- a third outer surface 8 and a fourth outer surface 9, which are opposite to each other and connect the first surface 10 to the second surface 11.

In a non-limiting example, the hollow end element 3 at least partially has a wedge shape which is suitable for possibly being inserted between the two casting rolls. Here, the third outer surface 8 and the fourth outer surface 9 define the wedge shape of the hollow end element 3 (FIGS. 7 to 14).

The third surface 8 and the fourth surface 9 can be flat or curvilinear, or partially flat and partially curvilinear, and converge towards a center plane Z of the hollow element 3 so as to define the wedge shape.

In case of curvilinear or partially curvilinear surfaces 8 and 9, the radius of curvature thereof substantially is equal to the outer radius of the corresponding casting roll.

By way of mere example, during the operation of the containment system of the invention, the minimum distance between the hollow end element 3 and the casting rolls 20, 21, that is the minimum distance between the surfaces 8, 9 and the corresponding casting roll, is about 0.5 to 2 mm, for example about 1 mm. Preferably, the distance between hollow end element 3 and the edge of the liquid metal material is about 8 to 12 mm, for example 10 mm.

In a variant of the hollow end element 3, the at least one inlet hole 5 can be provided in a fifth surface 16 (FIG. 4) which is distal from the pointed end 25 of the wedge shape and which connects both the first surface 10 to the second surface 11 and the third surface 8 to the fourth surface 9.

Figure 4:
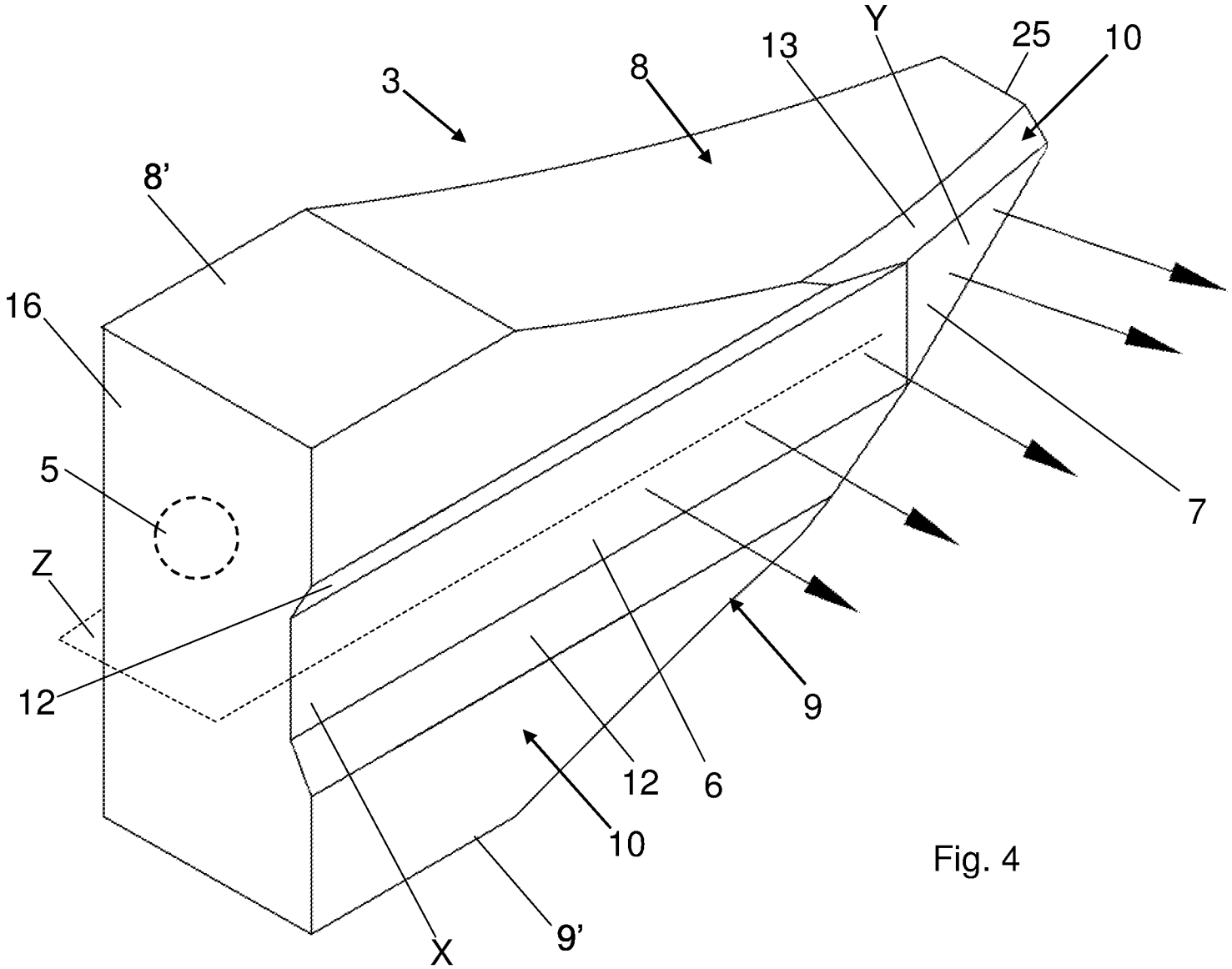
FIG. 4 shows a perspective view of a component of the system in FIG. 2.
Figure 5:
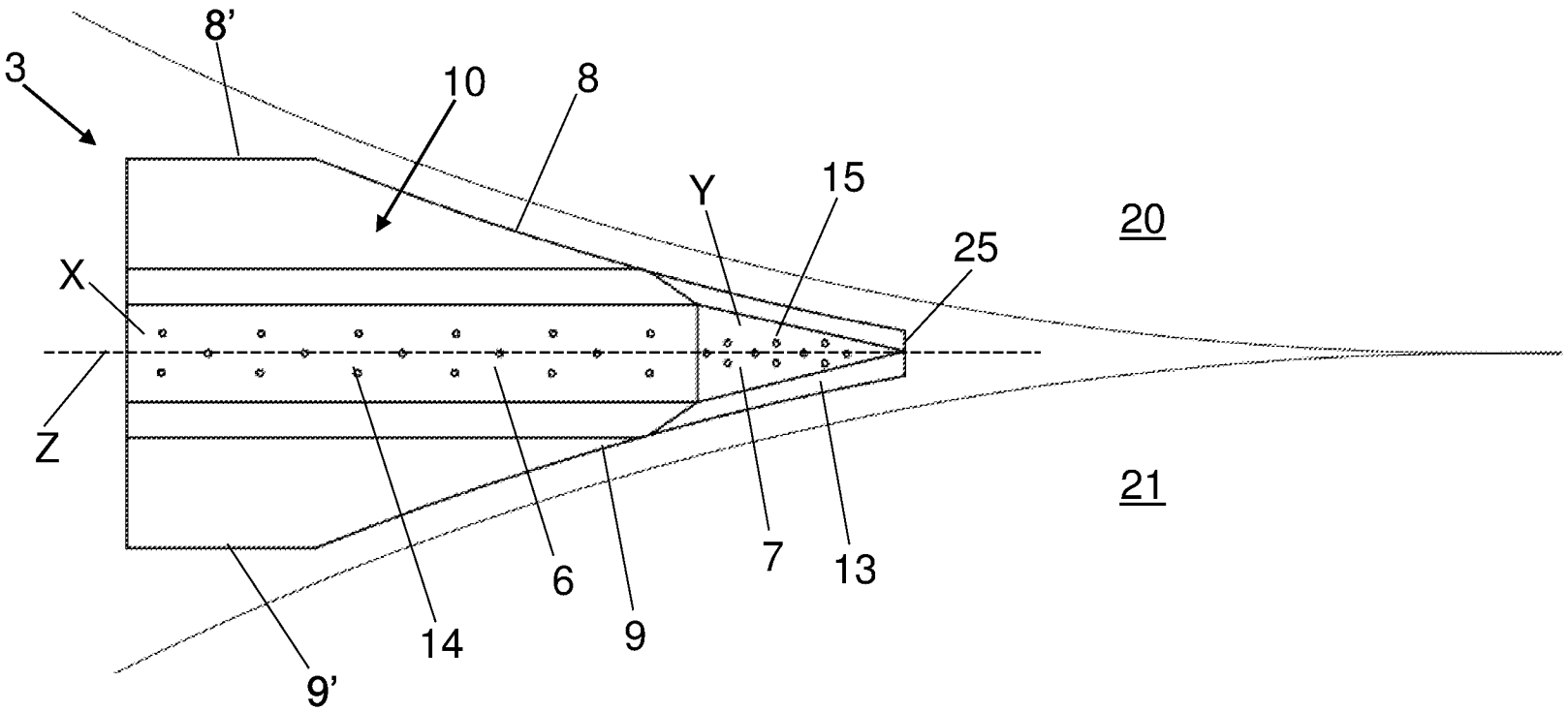
FIG. 5 shows a side view of a first variant of said component inserted between two casting rolls.

In the example in FIGS. 4 and 5, the third surface 8 and the fourth surface 9, which define the wedge shape, are curvilinear but also provided with a respective flat portion 8', 9' which is proximal to said fifth surface 16. At least one inlet hole for the at least one chamber 4 can also, or exclusively, be provided in the flat portion 8' and/or in the flat portion 9'. The flat portions 8' and 9' can also not be provided; in this case, the third surface 8 and the fourth surface 9 are entirely curved surfaces which define the wedge shape of the hollow end element 3.

Preferably, the third surface 8 and the fourth surface 9 are symmetrically arranged with respect to a center plane Z of the hollow element 3.

Advantageously, in all the embodiments of the invention, the hollow end element 3 can be made in a single piece by means of a 3D printer, preferably of a material selected from the following: graphite, calcium silicate, copper, bronze.

Alternatively, the hollow end element 3 can be made of several pieces, also of different material from one another.

For example, the piece or component comprising the at least one blowing face, or the pieces or components comprising a respective blowing face, can be made of a porous matrix material, for example sintered bronze or a ceramic foam, or be defined by a woven metal filament, or in which said matrix is obtained with additive manufacturing technologies.

Preferably, but not necessarily, the feeding device 2 can be a pneumatic device or any device adapted to compress and feed an aeriform substance.

In a first embodiment of the hollow end element 3, the first surface 10 is provided with two or more blowing faces, that are non-coplanar to each other, for differently orienting the flow of the aeriform substance towards the containment zone. This configuration allows blowing jets of air or inert gas in at least two directions, and therefore towards at least two different zones of the space enclosed between the two casting rolls, for an improved side containment of the liquid metal material and/or an increased extension of the containment region.

For example, the through holes of each blowing face are mutually parallel and inclined by an angle other than zero with respect to the through holes of the other blowing faces.

Preferably, a number of chambers 4 inside the hollow end element 3 can be provided which is equal to the number of blowing faces, each chamber feeding a respective blowing face.

In the variants shown in FIGS. 5, 6, 7, 8, 9 and 11 of this first embodiment, the hollow end element 3 has a wedge shape but, as mentioned above, said hollow element can have other shapes than the wedge shape.

A first variant of said first embodiment, shown in FIG. 5, provides two blowing faces 6, 7 on the first surface 10.

The blowing face 6 defines a plane X, and the blowing face 7, which preferably is adjacent to the blowing face 6, defines a plane Y incident to plane X.

The blowing face 6 is distal from the pointed end 25 of the hollow end element 3, while the blowing face 7 is proximal to said pointed end.

For example, the blowing face 6 is flat and rectangular-shaped, preferably elongated, while the blowing face 7 is flat and triangular-shaped, preferably shaped as an isosceles triangle, with the base of the isosceles triangle preferably adjacent to one of the two smaller sides of the rectangular shape of the blowing face 6.

The center plane Z divides the two blowing faces 6, 7 into two equal parts.

When the containment system is mounted at an open side end of the passage defined between the two counter-rotating casting rolls 20, 21, the blowing face 6 is arranged perpendicularly to a metal material feeding plane, and the blowing face 7 has a first end, which is proximal to both the blowing face 6 and the side containment zone, and a second end which is distal from both the blowing face 6 and said side containment zone.

In other words, as the blowing face 7 approaches the roll bite, it diverges with respect to a center plane of the casting rolls which is perpendicular to the plane containing both rotation axes of said casting rolls. Therefore, considering the feeding direction of the metal material, the blowing face 7 diverges with respect to the edge of the metal material entering between the casting rolls if the system is arranged on the side where the material enters between the rolls, or converges with respect to the edge of the metal material exiting from the casting rolls if the system is arranged on the side where the material exits from the rolls. Instead, the blowing face 6 is substantially parallel to said edge. This configuration allows blowing jets of air or inert gas directed towards the edge of the material, also towards an innermost zone which is proximal to the roll bite, in the space between the two casting rolls, for an increased side containment in a zone which is difficult for the mechanical barriers of the prior art to access.

In the example in FIG. 5, the blowing face 6 is provided with a plurality of through holes 14, while the blowing face 7 is provided with a plurality of through holes 15.

The through holes 14 can be mutually parallel and inclined with respect to the mutually parallel through holes 15, for example by an acute angle, preferably between 5° and 45°, more preferably between 100 and 35°. Arrows A and B in FIG. 6 indicate the direction of the jets exiting from the through holes 14 and 15, respectively.

As an alternative to the through holes, the blowing faces 6, 7 can be made of a porous matrix material.

Figure 7:
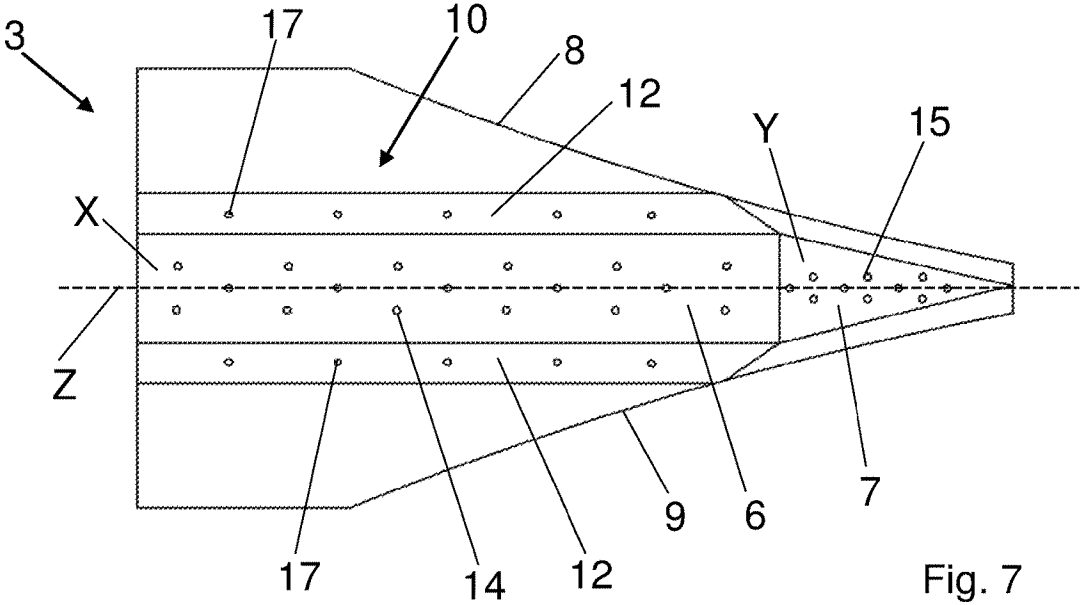
FIG. 7 shows a side view of a further variant of said component.

A second variant of said first embodiment, shown in FIG. 7, provides a first surface 10 provided with four non-coplanar blowing faces 6, 7, 12 for differently orienting the flow of the aeriform substance towards the containment zone.

In addition to the two blowing faces 6, 7 of the first variant, this second variant provides two side blowing faces 12 adjacent to the blowing face 6 and symmetrically arranged with respect to the center plane Z of the hollow end element 3 which divides both the blowing face 6 and the blowing face 7 into two equal parts.

When the containment system is mounted at an open side end of the passage defined between the two casting rolls, the two blowing faces 12 have a respective first end which is proximal to the blowing face 6 but distal from the side containment zone, with respect to a respective second end thereof which is distal from the blowing face 6 but proximal to the side containment zone.

In other words, each blowing face 12 defines a respective plane incident and adjacent to plane X of the blowing face 6 and, starting from plane X, diverges with respect to the center plane Z so as to allow blowing additional jets of air or inert gas converging, for example both from the top and from the bottom in case of a horizontal casting machine, towards the feeding plane of the metal material, in particular towards the edge of the metal material during the casting step for an increased side containment of liquid metal.

In particular, the side blowing faces 12 and the central blowing face 6 define a groove of the first surface 10.

By way of mere example, the blowing faces 12 are flat and rectangular or trapezoidal in shape, preferably in the shape of a rectangular trapeze, with the largest base of the rectangular trapeze preferably adjacent to one of the two larger sides of the rectangular shape of the blowing face 6.

In the example in FIG. 7, the blowing face 6 is provided with a plurality of through holes 14, the blowing face 7 is provided with a plurality of through holes 15, and the two blowing faces 12 are provided with a plurality of through holes 17.

The through holes 14 can be mutually parallel and inclined with respect to the mutually parallel through holes 15, for example by an acute angle, preferably between 5° and 45°, more preferably between 100 and 35°.

The through holes 17 can also be mutually parallel and inclined with respect to the through holes 14, for example by an acute angle, preferably between 5° and 45°, more preferably between 100 and 35°. However, the axes of the through holes 17 of the blowing faces 12 are skewed with respect to the axes of the through holes 15 of the blowing face 7.

As an alternative to the through holes, the blowing faces 6, 7, 12 can be made of a porous matrix material.

Figure 8:
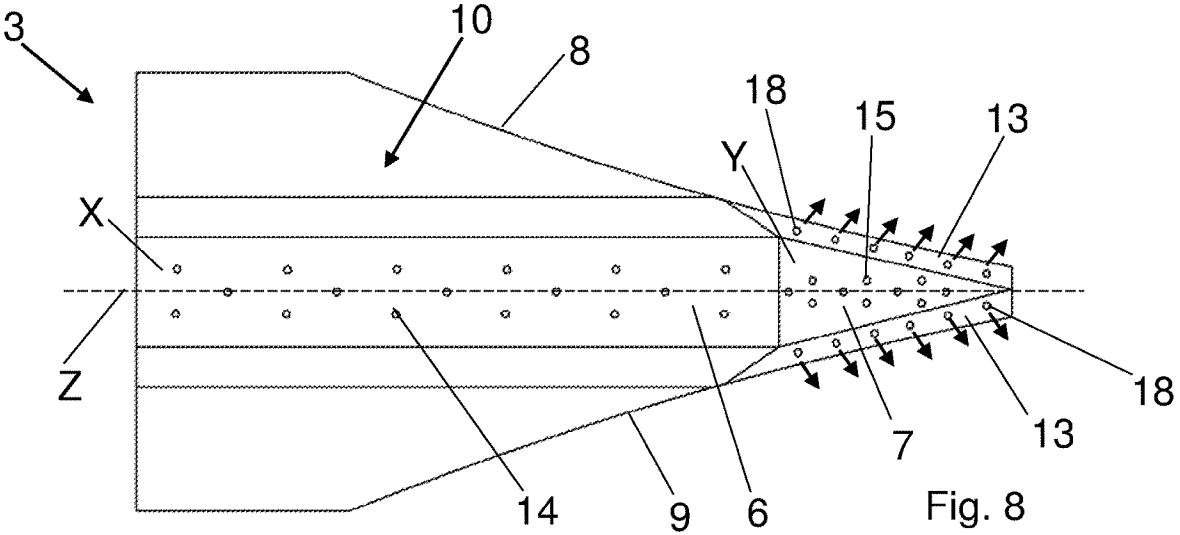
FIG. 8 shows a side view of a further variant of said component.

A third variant of said first embodiment, shown in FIG. 8, provides a first surface 10 provided with four non-coplanar blowing faces 6, 7, 13 for differently orienting the flow of the aeriform substance towards the containment zone.

In addition to the two blowing faces 6, 7 of the first variant, this third variant provides two side blowing faces 13 adjacent to the blowing face 7 and symmetrically arranged with respect to the center plane Z of the hollow end element 3 which divides both the blowing face 6 and the blowing face 7 into two equal parts.

When the containment system is mounted at an open side end of the passage defined between the two casting rolls, the two blowing faces 13 have a respective first end which is proximal both to the blowing face 7 and to the side containment zone, with respect to a respective second end thereof which is distal both from the blowing face 7 and from the side containment zone.

In other words, each blowing face 13 defines a respective plane incident and adjacent to plane Y of the blowing face 7 and, starting from plane Y, diverges with respect to the center plane Z so that the two blowing faces 13 face one towards the casting roll 20 and the other towards the casting roll 21, and therefore not facing towards the feeding plane of the metal material. This allows blowing additional jets of air or inert gas directed against the casting roll 20 and the casting roll 21 so that the same casting rolls confine the air in the space delimited therebetween, thus determining a zone with increased pressure in front of the edge of the product being cast, thus further decreasing the spreading of liquid metal in the proximity of the roll bite.

By way of mere example, the blowing faces 13 are flat and rectangular- or trapezoidal-shaped, preferably with the smallest base of the trapeze adjacent to one of the two equal sides of the isosceles triangle of the blowing face 7.

In the example in FIG. 8, the blowing face 6 is provided with a plurality of through holes 14, the blowing face 7 is provided with a plurality of through holes 15, and the two blowing faces 13 are provided with a plurality of through holes 18.

The through holes 14 can be mutually parallel and inclined with respect to the mutually parallel through holes 15, for example by an acute angle, preferably between 5° and 45°, more preferably between 100 and 35°.

The through holes 18 can be mutually parallel and inclined with respect to the through holes 15, for example by an acute angle, preferably between 5° and 45°, more preferably between 100 and 35°.

Preferably, the axes of the through holes 18 of the blowing faces 13 are skewed with respect to the axes of the through holes 14 of the blowing face 6.

As an alternative to the through holes, the blowing faces 6, 7, 13 can be made of a porous matrix material.

Figure 9:
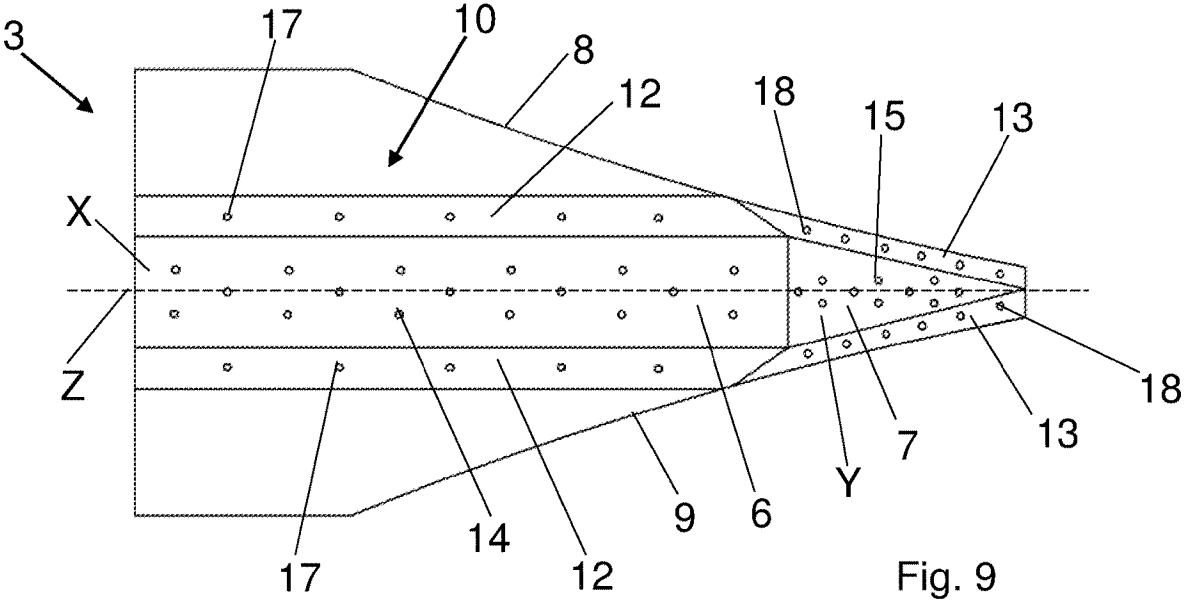
FIG. 9 shows a side view of a further variant of said component.

A fourth variant of said first embodiment, shown in FIG. 9, provides a first surface 10 provided with six non-coplanar blowing faces 6, 7, 12, 13 for differently orienting the flow of the aeriform substance towards the containment zone.

In addition to the two blowing faces 6, 7 of the first variant, this fourth variant provides both the two additional blowing faces 13 provided in the third variant and the two additional blowing faces 12 provided in the second variant.

Figure 11:
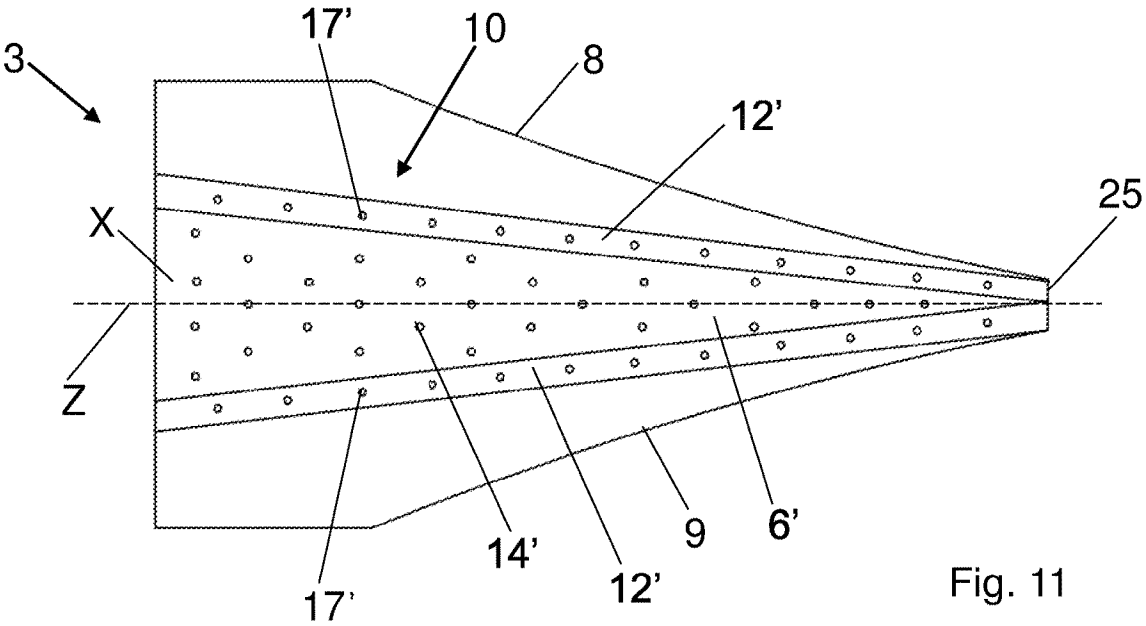
FIG. 11 shows a side view of a further variant of said component.

A fifth variant of said first embodiment, shown in FIG. 11, provides a first surface 10 provided with three non-coplanar blowing faces 6', 12' for differently orienting the flow of the aeriform substance towards the containment zone.

The central blowing face 6 defines a first plane X and the two side blowing faces 12' are adjacent to the blowing face 6 and symmetrically arranged with respect to the center plane Z of the hollow end element 3 which divides the blowing face 6 into two equal parts.

When the containment system is mounted at an open side end of the passage defined between the two casting rolls, the two blowing faces 12' have a respective first end which is proximal to the blowing face 6' but distal from the side containment zone, with respect to a respective second end thereof which is distal from the first blowing face 6 but proximal to the side containment zone.

In other words, each blowing face 12' defines a respective plane incident and adjacent to plane X of the blowing face 6' and, starting from plane X, diverges with respect to the center plane Z so as to allow blowing additional jets of air or inert gas converging, for example both from the top and from the bottom in case of a horizontal casting machine, towards the feeding plane of the metal material, in particular towards the edge of the metal material during the casting step for an increased side containment of liquid metal.

In particular, the side blowing faces 12' and the central blowing face 6' define a groove of the first surface 10.

For example, the central blowing face 6' is flat and triangular-shaped, preferably the shape of an isosceles triangle, and the blowing faces 12' are flat and rectangular or trapezoidal in shape, with a side adjacent to one of the equal sides of the isosceles triangle shape of the blowing face 6'.

In the example in FIG. 11, the blowing face 6' is provided with a plurality of through holes 14' and the two blowing faces 12' are provided with a plurality of through holes 17'.

The through holes 17' of each side blowing face 12' can be mutually parallel and inclined with respect to the through holes 14', for example by an acute angle, preferably between 5° and 45°, more preferably between 100 and 35°.

As an alternative to the through holes, the blowing faces 6', 12' can be made of a porous matrix material.

In a second embodiment of the hollow end element 3, the first surface 10 is provided with a single blowing face in which two or more groups of through holes are provided, preferably of various sizes, each group being differently oriented from the other groups to differently orient the flow of the aeriform substance towards the containment zone. This configuration allows blowing jets of air or inert gas directed towards the edge of the material in at least two directions, and therefore towards at least two different zones of the space enclosed between the two casting rolls, for an improved side containment and an increased extension of the containment region.

For example, the through holes of each group are mutually parallel and inclined by an angle other than zero with respect to the through holes of the other groups.

Preferably, one, two or also more than two chambers 4 are provided inside the hollow end element 3.

In the variants shown in FIGS. 10, 12, 13 and 14 of this second embodiment, the hollow end element 3 has a wedge shape but, as mentioned above, said hollow element can have other shapes than the wedge shape.

Figure 10:
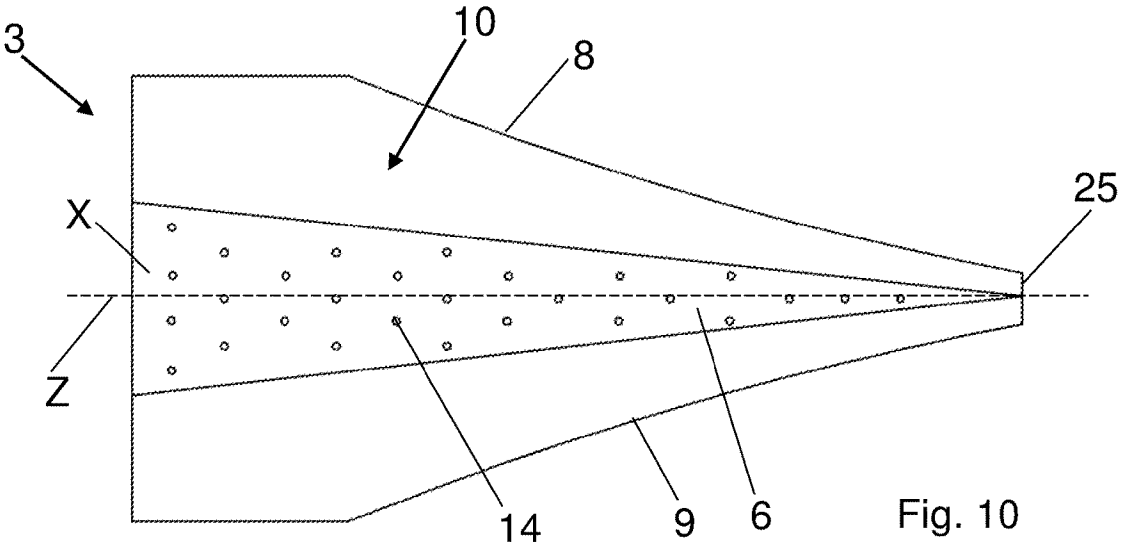
FIG. 10 shows a side view of a further variant of said component.

A first variant of said second embodiment, shown in FIG. 10, provides a single blowing face 6 on the first surface 10, the blowing face preferably being made in a recess of said first surface 10.

The central blowing face 6 is a flat or curvilinear face.

When the containment system is mounted at an open side end of the passage defined between the two counter-rotating casting rolls, the blowing face 6, if it is flat, is arranged perpendicularly to a metal material feeding plane.

Instead, in the case of a curvilinear face, as it approaches the roll bite, said face diverges with respect to a center plane of the casting rolls which is perpendicular to the plane containing both rotation axes of said casting rolls. Therefore, considering the feeding direction of the metal material, the blowing face 6 diverges with respect to the edge of the metal material entering between the casting rolls if the system is arranged on the side where the material enters between the rolls, or converges with respect to the edge of the metal material exiting from the casting rolls if the system is arranged on the side where the material exits from the rolls. This configuration allows blowing jets of air or inert gas directed towards the edge of the material, also towards an innermost zone which is proximal to the roll bite, in the space between the two casting rolls, for an increased side containment in a zone which is difficult for the mechanical barriers of the prior art to access.

In the example in FIG. 10, the blowing face 6 is triangular with the vertex at the pointed end 25 of the wedge-shaped hollow end element 3.

The center plane Z divides the blowing face 6 into two equal parts.

In the example in FIG. 10, the blowing face 6 is provided with a plurality of through holes 14.

Two or more groups of through holes 14 can be provided, for example of various size, each group of holes having a different orientation or inclination from the other groups to differently orient the flow of the aeriform substance towards the containment zone. Thereby, differently oriented jets of air or inert gas can be obtained in a similar manner to the jets obtained with the various variants of the first embodiment which provides two or more blowing faces.

Figure 12:
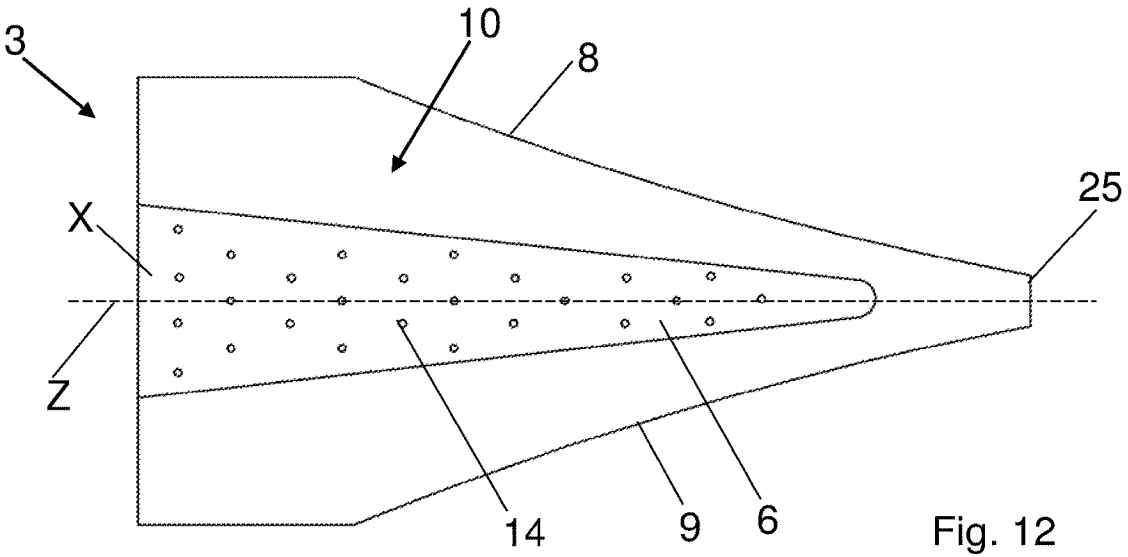
FIG. 12 shows a side view of a further variant of said component.

A second variant of said second embodiment, shown in FIG. 12, is equal to the variant in FIG. 10 except for having the blowing face 6 with a substantially triangular shape, having the, preferably rounded, vertex conveniently spaced apart from the pointed end 25 of the wedge-shaped hollow end element 3.

Figure 13:
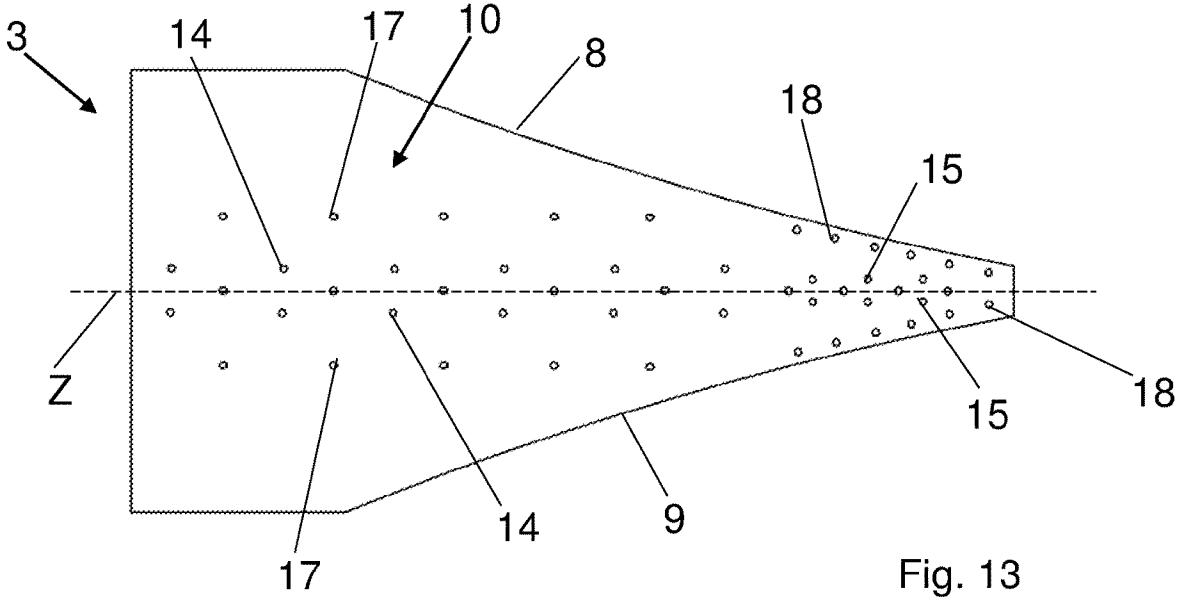
FIG. 13 shows a side view of a further variant of said component.
Figure 14:
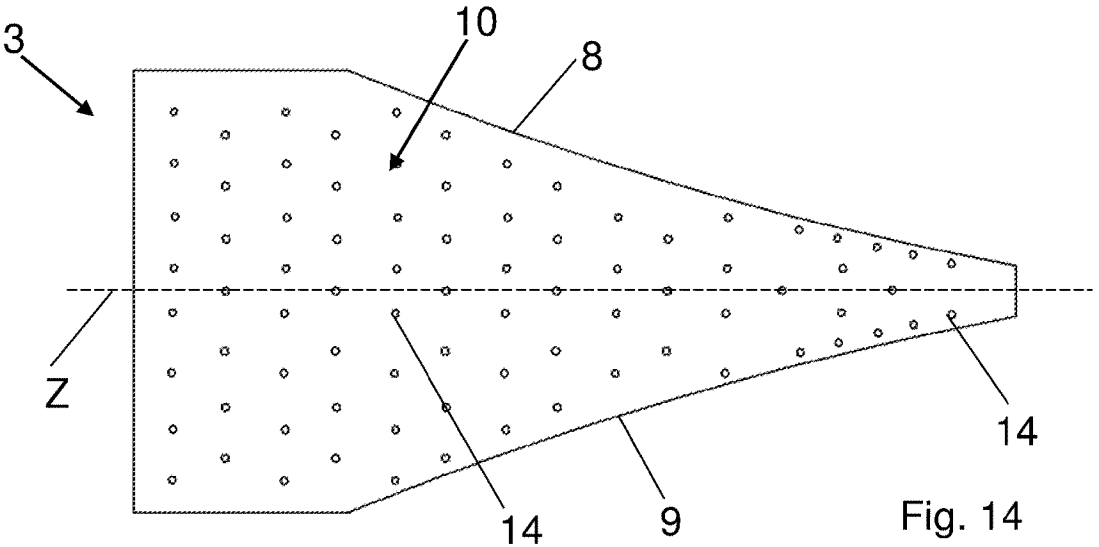
FIG. 14 shows a side view of a further variant of said component.

A third and fourth variant of said second embodiment, shown in FIG. 13 and FIG. 14, respectively, provide a completely flat or curvilinear first surface 10 coinciding with the only blowing face.

The surface 10 is provided with two or more groups of through holes, preferably of various sizes, each group being differently oriented from the other groups to differently orient the flow of the aeriform substance towards the containment zone.

For example, two or more groups of through holes can be provided, each group of holes having a different orientation or inclination with respect to the other groups to obtain differently oriented jets of air or inert gas in a similar manner to the jets obtained with the various variants of the first embodiment which provides two or more blowing faces.

In the example in FIG. 13, the through holes are distributed in a different manner over surface 10, but exclusively in a central zone of the surface 10. In particular, the through holes can be divided into six groups corresponding to the through holes 14, 15, 17, 18, respectively, of the variant in FIG. 9, which provides six blowing faces.

In the example in FIG. 14, the through holes 14 are distributed in a different manner but substantially over the whole surface 10.

In all the variants shown above (FIGS. 5 to 14), the through holes can be arranged in a honeycomb configuration on one or more blowing faces, i.e., with a distribution of the through holes in offset rows. Preferably, the density of the holes on the surface 10 of the hollow end element 3 is obtained so that the total area of the holes on the surface 10 is between 50% and 70% of the area of the surface 10.

Figure 3:
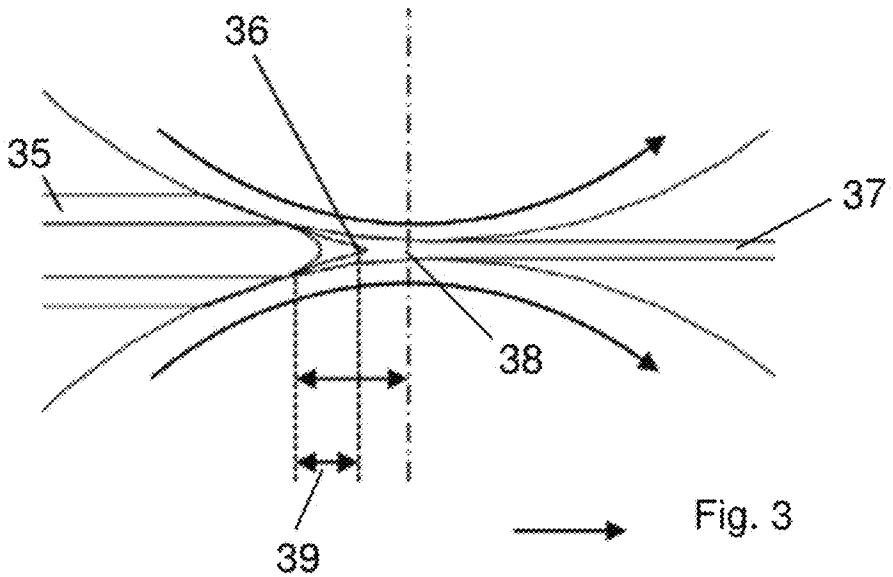
FIG. 3 shows a cross section of the casting machine which illustrates the solidification area.

A solidification process of a liquid metal material by means of a casting machine is shown in FIGS. 1 to 3. In this process, the products, for example strips or sheets, are directly cast by feeding liquid metal material through the discharger 35 between two cooled and counter-rotating casting rolls 20, 21. A cross-section of the solidification region is shown in FIG. 3. As soon as the liquid metal material touches the rolls 20, 21, a solid shell begins to form which increases by moving towards the outlet passage 38. The solid shells adhering to the upper roll 20 and to the lower roll 21 meet in a solidification point 36 just before the outlet passage 38 (usually the total solidification length is about 10 to 20 mm for a conventional process with casting speed of about 1.2 m/min and thickness of the metal sheet of 5 mm), and from there the metal product is deformed by the casting rolls 20, 21, thus obtaining the cast product 37.

The containment system of the invention in any one of the embodiments thereof can be used in particular to manipulate the liquid metal or liquid metal alloy by applying a pressure along the sump depth 39 (FIG. 3, corresponding to the actual solidification length) during casting. This pressure, which is exclusively generated by the air or inert gas blown by the feeding device 2, controls the position of the side edge of the metal material in the region between the discharger 35 and the outlet passage 38, where a real physical containment is absent.

The containment system of the invention can also be used downstream of the outlet passage 38 to contain liquid metal material still present at the outlet from the casting rolls.

The invention claimed is:

1. A containment system for laterally containing an at least partially liquid metal material at an open side end of a passage defined between two casting members, said system comprising a feeding device for feeding at least one compressed aeriform substance, wherein said feeding device is provided with a hollow end element adapted to be arranged at least partially between the two casting members, wherein said hollow end element defines at least one chamber therein, wherein said feeding device is adapted to feed the at least one compressed aeriform substance into said at least one chamber, wherein said hollow end element is provided with at least one blowing face for blowing said at least one compressed aeriform substance from said at least one chamber towards a side containment zone of said at least partially liquid metal material;

wherein said at least one blowing face is provided with a plurality of through holes;

and wherein two or more non-coplanar blowing faces are provided for differently orienting a flow of said at least one aeriform substance, or wherein only one blowing face is provided in which two or more groups of through holes are provided for differently orienting a flow of said at least one aeriform substance.

2. The system according to claim 1, wherein, in case of two or more non-coplanar blowing faces, the through holes of each blowing face are mutually parallel and inclined by an angle other than zero with respect to the through holes of the other blowing faces, or wherein, in case of only one blowing face with two or more groups of through holes, the through holes of each group are mutually parallel and inclined by an angle other than zero with respect to the through holes of the other groups.

3. The system according to claim 1, wherein said hollow end element has at least partially a wedge shape which is configured to be inserted between the two casting members.

4. The system according to claim 1, wherein said hollow end element comprises at least one first outer surface adapted to face towards the side containment zone and comprising said at least one blowing face;

and wherein said hollow end element also comprises a second outer surface opposite to said at least one first outer surface, a third outer surface and a fourth outer surface, which are opposite to each other and connect the at least one first outer surface to the second outer surface.

5. The system according to claim 4, wherein said third outer surface and said fourth outer surface define a wedge shape of the hollow end element.

6. The system according to claim 1, wherein a first blowing face, defining a first plane X, and a second blowing face, defining a second plane Y which is incident to the first plane X, are provided, and wherein, when the system is mounted at an open side end of said passage, the first blowing face is arranged perpendicularly to a liquid metal feeding plane, and the second blowing face has a first end, which is proximal to both the first blowing face and the side containment zone, and a second end which is distal from both the first blowing face and said side containment zone.

7. The system according to claim 6, wherein said hollow end element has a center plane which is perpendicular to the first plane X, and wherein two third blowing faces adjacent to the first blowing face and arranged symmetrically to said center plane are provided, and wherein, when the system is mounted at an open side end of said passage, the third blowing faces have a respective first end which is proximal to the first blowing face but distal from the side containment zone, with respect to a respective second end which is distal from the first blowing face but proximal to the side containment zone.

8. The system according to claim 6, wherein said hollow end element has a center plane which is perpendicular to the first plane X, and wherein two further blowing faces adjacent to the second blowing face and arranged symmetrically to said center plane are provided, and wherein, when the system is mounted at an open side end of said passage, the further blowing faces have a respective first end which is proximal to both the second blowing face and the side containment zone, with respect to a respective second end which is distal from both the second blowing face and the side containment zone.

9. The system according to claim 1, wherein said hollow end element is made in a single piece.

10. A casting machine for casting metal material products, said casting machine comprising:

two casting members defining a passage having two open side ends, for solidifying a liquid metal material fed into a space between said casting members and forming a product;

a first containment system according to claim 1, arranged at least partially between the two casting members at a first open side end of said passage.

11. The casting machine according to claim 10, wherein the two casting members are two casting rolls placed one above the other with rotation axes lying on a common plane.

12. The casting machine according to claim 11, wherein moving means for moving a hollow end element of the first containment system and/or the hollow end element of the second containment system are provided in order to adjust a distance from each other along a direction parallel to the common plane containing the rotation axes of the two casting rolls.

13. The casting machine according to claim 11, wherein a hollow end element of the first containment system and the hollow end element of the second containment system have at least partially a wedge shape for being inserted at least partially between the two casting rolls.

14. The casting machine according to claim 13, wherein a distance other than zero is provided between the hollow end element and any surface of the casting rolls both when the hollow end element is completely external to the casting rolls and when said hollow end element is at least partially inserted between said casting rolls with the wedge shape thereof.

15. The casting machine according to claim 11, wherein said metal material is aluminum or magnesium or zinc or a metal alloy based on one of these metals.

16. The casting machine according to claim 10, wherein a second containment system according to claim 1 is arranged at least partially between the two casting members at a second open side end of said passage.

17. The casting machine according to claim 10, wherein said two casting members are counter-rotating rolls or belts or tracks or a combination thereof.

18. A casting process for casting metal material products, which is carried out by a casting machine according to claim 10, the process comprising the following stages:

feeding the liquid metal material into the space between the two casting members;

solidifying the metal material and forming a product in the passage between the two casting members;

wherein a side containment of the liquid metal material is provided at least at one of the two open side ends of the passage by means of a first containment system;

and wherein the side containment of the liquid metal material is obtained by feeding at least one compressed aeriform substance to at least one chamber of a hollow end element which, by means of at least one blowing face, blows at least one compressed aeriform substance from the at least one chamber towards a side containment zone of said liquid metal material.

19. The casting process according to claim 18, wherein the at least one blowing face applies a side containment action of the metal material only by blowing the at least one compressed aeriform substance without providing any contact of said at least one blowing face with the metal material being solidified.

20. The casting process according to claim 18, wherein a first side containment of the liquid metal material is provided at a first open side end of the passage by means of said first containment system, and a second side containment of the liquid metal material is provided at a second open side end of said passage by means of a second containment system.

* * * * *